US010209039B2

(12) United States Patent
Bei et al.

(10) Patent No.: US 10,209,039 B2
(45) Date of Patent: Feb. 19, 2019

(54) BULLET COLLECTING ROBOT, BULLET COLLECTING DEVICE THEREOF AND SHOOTING GAME SYSTEM

(71) Applicant: SZ DJI TECHNOLOGY CO., LTD., Shenzhen (CN)

(72) Inventors: Shimeng Bei, Shenzhen (CN); Yijun Guan, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/471,239

(22) Filed: Mar. 28, 2017

(65) Prior Publication Data

US 2017/0199014 A1 Jul. 13, 2017

Related U.S. Application Data

(63) Continuation of application No. PCT/CN2014/088027, filed on Sep. 30, 2014.

(51) Int. Cl.

| | |
|---|---|
| ***A63B 47/02*** | (2006.01) |
| ***F41J 13/00*** | (2009.01) |
| ***A63F 9/02*** | (2006.01) |

(52) U.S. Cl.

CPC ..... *F41J 13/00* (2013.01); *A63B 47/021* (2013.01); *A63F 9/02* (2013.01)

(58) Field of Classification Search

CPC ..... A63B 67/00; A63B 67/04; A63B 69/00; A63B 47/021; A63B 2102/116; A63B 2047/022; A63F 9/02; F41J 13/00

See application file for complete search history.

(56) References Cited

U.S. PATENT DOCUMENTS

| | | | | |
|---|---|---|---|---|
| 2,729,046 A * | 1/1956 | Patterson | ..... | A01D 51/002 198/506 |
| 2,756,978 A | 7/1956 | Wachsmith | | |
| 3,102,647 A * | 9/1963 | Bonney | ..... | A63B 47/021 414/440 |

(Continued)

FOREIGN PATENT DOCUMENTS

| | | |
|---|---|---|
| CN | 2234936 Y | 9/1996 |
| CN | 101439227 A | 5/2009 |

(Continued)

OTHER PUBLICATIONS

The World Intellectual Property Organization (WIPO) International Search Report for PCT/CN2014/088027 dated May 28, 2015 9 Pages.

*Primary Examiner* — Raleigh W Chiu
(74) *Attorney, Agent, or Firm* — Anova Law Group, PLLC

(57) ABSTRACT

A bullet collecting robot comprises a bullet collecting device, a travel driving mechanism, and a controller. The bullet collecting device comprises a collection bin including a bullet accommodating cavity and a collection opening in communication with the bullet accommodating cavity, a friction roller provided at the collection opening, and a collection driving member connected with the friction roller. The travel driving mechanism is configured to drive the bullet collecting device to move. The controller is connected in communication with the collection driving member and the travel driving mechanism, and is configured to control the collection driving member and the travel driving mechanism.

20 Claims, 15 Drawing Sheets

(56) References Cited

U.S. PATENT DOCUMENTS 3,485,398 A * 12/1969 Offner ..... A63B 47/021 414/440
3,784,037 A * 1/1974 Woodall ..... A63B 47/021 414/440
3,888,370 A * 6/1975 Gamblin ..... A63B 47/021 414/440
3,989,151 A * 11/1976 Dyer ..... A63B 47/021 414/437
3,995,759 A * 12/1976 Hollrock ..... A01D 51/00 414/440
4,077,533 A * 3/1978 Meyer ..... A63B 47/021 414/440
4,157,141 A * 6/1979 Ryan ..... A63B 47/021 171/66
4,735,544 A * 4/1988 Stotts ..... A63B 47/021 414/440
5,141,383 A * 8/1992 Phillips ..... A63B 47/021 414/440
5,417,538 A * 5/1995 Wilde ..... A63B 47/02 414/434
5,980,392 A * 11/1999 Cox ..... A63B 47/021 473/167
6,079,930 A * 6/2000 Valdes-Rodriguez ..... A63B 47/021 294/19.2
6,470,618 B1 10/2002 White
7,674,196 B2 * 3/2010 Tsai ..... A63B 47/021 414/440
2005/0204717 A1 * 9/2005 Colens ..... A63B 47/021 56/344
2009/0137348 A1 * 5/2009 Tsai ..... A63B 47/021 473/436
2014/0294547 A1 * 10/2014 Guo ..... A63B 47/021 414/507
2015/0328503 A1 * 11/2015 Vilar ..... A63B 47/021 473/460
2016/0243970 A1 * 8/2016 Eletrabi ..... B60P 1/00

FOREIGN PATENT DOCUMENTS

CN 201268008 Y 7/2009
CN 201482115 U 5/2010
CN 201653286 U 11/2010
CN 102137800 A 7/2011
CN 103955150 A 7/2014
CN 204275487 U 4/2015
JP S5786370 A 5/1982
JP H04164464 A 6/1992
JP H05306898 A 11/1993
JP 2000205792 A 7/2000
KR 20100065428 A 6/2010

* cited by examiner

BULLET COLLECTING ROBOT, BULLET COLLECTING DEVICE THEREOF AND SHOOTING GAME SYSTEM

CROSS-REFERENCE TO RELATED APPLICATION

This is a continuation application of International Application No. PCT/CN2014/088027, filed on Sep. 30, 2014, the entire contents of which are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present disclosure relates to a robot, and more particularly to a bullet collecting robot and a bullet collecting device thereof, as well as a shooting game system utilizing the bullet collecting robot.

BACKGROUND OF THE PRESENT DISCLOSURE

During a shooting robot dual meet, a shooting robot would use two different types of bullets, in which one is a flash bullet with a diameter of 17 mm and a weight of 5 g, while another is a golf ball shell with a diameter of 42.64 mm and a weight of 45.93 g. Before the game starts, both sides may each have about 500-400 flash bullets and 30 golf ball shells; during the game, both sides may fire bullets to each other; after the game finished, flash bullets and golf ball shells may spread all over the field. After the game, flash bullets and golf ball shells may be recycled manually. The flash bullets and golf ball shells may continue to be used next time after being recycled from the field.

However, the foregoing manner of collecting bullets is a manual collection, which may require humans to pick up bullets by hands and may be relatively inconvenient.

SUMMARY OF THE PRESENT DISCLOSURE

In view of this, the present disclosure to provide a bullet collecting device which may collect bullets automatically in a convenient way.

According to an aspect of the present disclosure, a bullet collecting device is provided. The bullet collecting device may comprise a collection bin provided with a bullet accommodating cavity and a collection opening in communication with the bullet accommodating cavity, wherein an inner wall of the collection opening is provided with a collection surface for rolling of bullets. The bullet collecting device may also comprise a friction roller provided at the collection opening and capable of rotating freely, wherein a rotation shaft of the friction roller may be disposed opposite to and spaced from the collection surface, such that a preset gap exists between a peripheral surface of the friction roller and the collection surface. The bullet collecting device may further comprise a collection driving member connected with the friction roller and configured to drive the friction roller to rotate about the rotation shaft.

In some embodiments, when the bullets are located outside of the friction roller, the friction roller may rotate such that the bullets may be caught into the collection opening from the preset gap and roll into the bullet accommodating cavity along the collection surface.

Compared to a traditional technique, the foregoing bullet collecting device may have at least the following advantages:

(1) The foregoing bullet collecting device may drive the friction roller to rotate through the collection driving member, and the bullets may be caught by the friction roller into the collection opening from the preset gap and roll into the bullet accommodating cavity along the collection surface, thereby making it easy for collecting the bullets on the ground.

(2) The foregoing bullet collecting device may allow, by use of the friction roller, the bullets to be caught into the collection opening from the preset gap and to roll into the bullet accommodating cavity along the collection surface, whereas other objects with a particle diameter less than the preset gap between the peripheral surface of the friction roller and the collection surface would leak from the collection opening automatically. For example, sundries on the ground with a particle diameter less than the preset gap may not be caught into the collection bin by the friction roller; thus the bullet collecting device may be able to collect bullets selectively.

In some embodiments, the friction roller may comprise an inner tube and a sponge sleeve that may be fixedly sleeved on the inner tube.

In some embodiments, the inner tube may be a carbon fiber tube.

In some embodiments, the collection driving member may be a brushless motor, and a rotor of the brushless motor may be received within an opening end of the inner tube and fixedly connected with the opening end of the inner tube, such that the inner tube may rotate along with the rotor of the brushless motor.

In some embodiments, the friction roller may comprise a stationary shaft and a rubber roller that may be fixedly sleeved on the stationary shaft. Alternatively, the friction roller may comprise a rubber roller and two stationary shafts that may be fixed on two ends of the rubber roller respectively and disposed coaxially with the rubber roller.

In some embodiments, the collection driving member may be a brush motor, and a driving shaft of the brush motor may be coaxially and fixedly connected with the stationary shaft.

In some embodiments, the collection surface may be a rising slope surface through which the bullets may roll into the bullet accommodating cavity.

In some embodiments, the slope surface may be a flat surface or an arc-shaped surface.

In some embodiments, the collection bin may comprise a baseplate, two side plates, an upper cover and a protective shield, wherein the upper cover may be disposed opposite to the baseplate, and one end of the upper cover may be connected with one end of the baseplate, while the other end of the upper cover may be connected with the protective shield, and the two side plates may be disposed opposite to and spaced from each other and fixedly connected with the baseplate and two opposite sides of the protective shield, respectively. The protective shield and an end of the baseplate that is distal from the upper cover together form the collection opening. The collection surface may be provided on the baseplate.

In some embodiments, the one end of the upper cover may be detachably connected with the one end of the baseplate, while the other end may be rotatably connected with the protective shield.

In some embodiments, two collection driving members may be provided, which may be fixed on the two side plates respectively and drive two ends of the friction roller respectively.

In some embodiments, the collection bin may be a rounded shell structure with a plurality of collection openings disposed around the periphery of the collection bin, and there may be a plurality of friction rollers disposed corresponding to the plurality of collection openings respectively.

In some embodiments, there may be a plurality of collection driving members, each of which may drive two adjacent friction rollers to rotate simultaneously by a transmission mechanism.

In some embodiments, the transmission mechanism may comprise at least one of the followings: a worm gear and worm transmission mechanism, a helical gear set transmission mechanism and a belt transmission mechanism.

In some embodiments, the device may further comprise a bullet classifying mechanism configured to separate different types of bullets, wherein the bullet classifying mechanism may be mounted within the collection bin.

In some embodiments, the bullet classifying mechanism may comprise a partition plate mounted at the entrance of the bullet accommodating cavity, and the partition plate may be provided with a hollowed-out filter groove thereon.

In some embodiments, there may be a plurality of filter grooves, each of which may be a long and narrow groove.

In some embodiments, the partition plate may be disposed obliquely, allowing the bullets which could not pass through the filter groove to roll along the partition plate under their own gravity.

In some embodiments, one end of the partition plate close to the entrance of the bullet accommodating cavity may be provided with a bending portion so as to form a V-shaped limiting rib, and the bullets may climb over the limiting rib to get into the area where the filter groove is located.

In some embodiments, the bullet classifying mechanism may comprise a main pipe and a plurality of branch pipes, wherein the main pipe may be provided with a channel therein with a V-shaped cross section, and the plurality of branch pipes may be in communication with the main pipe and correspond to different widths of the main pipe respectively, and the bullets of different sizes may roll along areas with different widths in the channel of the main pipe.

According to another aspect of the present disclosure, a bullet collecting robot is provided. The bullet collecting robot may comprise a bullet collecting device as discussed above. The bullet collecting robot may also comprise a travel driving mechanism configured to drive the bullet collecting device to move. The bullet collecting robot may additionally comprise a controller connected in communication with the collection driving member and the travel driving mechanism and configured to control the collection driving member and the travel driving mechanism.

In some embodiments, the travel driving mechanism may comprise two differential driving wheel components, wherein the two differential driving wheel components may be disposed opposite to and spaced from each other and provided on two opposite sides of a bottom of the collection bin respectively.

In some embodiments, each of the differential driving wheel components may comprise a traveling wheel, a wheel axle and a chassis motor, wherein the chassis motor may be fixedly connected with the traveling wheel through the wheel axle and drive the traveling wheel to rotate.

In some embodiments, each of the differential driving wheel components may further comprise a motor base that may be a U-shaped structure with two support arms. The wheel axle may drivably pass through one of the support arms of the motor base, while the chassis motor may be fixedly connected with the other support arm of the motor base. A driving shaft of the chassis motor may rotatably pass through the other support arm of the motor base and be fixedly connected with the wheel axle; a bottom of the motor base may be fixedly connected with the bottom of the collection bin.

In some embodiments, each of the differential driving wheel components may further comprise a coupling, which may comprise an upper housing portion with an upper mounting groove and a lower housing portion with a lower mounting groove, wherein the upper housing portion may be detachably spliced with the lower housing portion, and the upper mounting groove and the lower mounting groove may together form a connecting axle hole, within which an end of the wheel axle and the driving shaft of the chassis motor may be fixed.

In some embodiments, the connecting axle hole may be a stepped hole, and the stepped hole may comprise a large hole portion and a small hole portion in communication with the large hole portion. At least one of the upper housing portion and the lower housing portion may be provided with a pin hole thereon in communication with the large hole portion, and an end of the wheel axle which may be inserted into the large hole portion of the connecting axle hole may be provided with a fixing hole. The fixing hole may correspond to the pin hole and is configured for a limiting pin to pass through.

In some embodiments, each of the differential driving wheel components may further comprise a bearing mounted within a through-hole provided for the wheel axle to pass through on one of the support arms of the motor base, wherein the wheel axle may pass through the bearing.

In some embodiments, the travel driving mechanism may further comprise two universal wheels, and the two universal wheels may be disposed opposite to and spaced from each other and mounted on the bottom of the collection bin.

In some embodiments, the two differential driving wheel components may be provided at the front of the bottom of the collection bin, while the two universal wheels may be provided at the back of the bottom of the collection bin, so as to form a forward drive traveling mechanism.

In some embodiments, the travel driving mechanism may further comprise two guiding wheels, and the two guiding wheels may be disposed opposite to and spaced from each other and may be mounted at the front of the bottom of the collection bin, and the two differential driving wheel components may be provided at the back of the bottom of the collection bin, so as to form a backward drive traveling mechanism.

In some embodiments, the travel driving mechanism may be a four-wheel omni-directional chassis mechanism or a three-wheel omni-directional chassis mechanism.

In some embodiments, the bullet collecting robot may further comprise a bullet supply device connected in communication with the controller, and configured to output the bullets within the bullet accommodating cavity.

In some embodiments, the bullet supply device may comprise a supply motor, a rotary disk and a output track. In one embodiment, the supply motor drives the rotary disk to rotate, and the rotary disk is provided with a push plate radially extending along the rotary disk. In one embodiment, one end of the output track may extend out of the collection bin and the other end of the output track may be joined with an edge of the rotary disk, and the output track may be provided with a slide slot for rolling of the bullets;

In some embodiments, the push plate may push the bullets on the rotary disk along with a rotation of the rotary disk, allowing the bullets to be pushed into the slide slot of the output track, and the bullets may roll outside of the collection bin along the slide slot under the force of their own gravity.

In some embodiments, the bottom of the bullet accommodating cavity may be provided with a valve mechanism for rolling out of the bullets, and the bullet supply device may comprise a supply driving device and a plurality of bullet cartridges. The supply driving device may comprise a driving cylinder and a push rod fixedly connected with a retractable rod of the driving cylinder and configured to push the bullet cartridges; the bullet cartridges may be mounted below the bullet accommodating cavity, and when one of the bullet cartridges is filled with bullets, the supply driving device may push the bullet cartridge filled with bullets out of the collection bin and push an empty bullet cartridge just below the valve mechanism.

In some embodiments, the bullet collecting robot may further comprise a wireless transmission device connected in communication with the controller, wherein the controller may accept a request signal for bullet supply from an external device to be supplied and transmit a signal of being ready for bullet supply via the wireless transmission device.

According to yet another aspect of the present disclosure, a shooting game system is provided. The shooting game system may comprise at least one of the foregoing bullet collecting robot. The shooting game system may also comprise a plurality of remotely controlled chariots capable of firing bullets, the plurality of remotely controlled chariots being divided into two sides involved in the game;

In some embodiments, the bullet collecting robot may be capable of being joined automatically with the remotely controlled chariot to be supplied and providing bullet supply.

In some embodiments, there may be a plurality of bullet collecting robots which may be divided into two teams providing bullet supply for the remotely controlled chariots of both sides respectively; a remotely controlled chariot may transmit a request signal for bullet supply automatically when the number of its current remaining bullets is less than a preset number of bullets;

In some embodiments, when a bullet collecting robot receives the request signal for bullet supply from the remotely controlled chariot of its own side, it may automatically follow the remotely controlled chariot around to provide bullet supply.

In some embodiments, the bullet collecting robot may move within a preset bullet supply area and provide bullet supply for the remotely controlled chariots which enter into the bullet supply area.

According to a further aspect of the present disclosure, a bullet collecting robot is provided. The bullet collecting robot may comprise a bullet collecting device configured to collect bullets. The bullet collecting robot may also comprise a travel driving mechanism configured to drive the bullet collecting device to move. The travel driving mechanism may comprise two differential driving wheel components, wherein the two differential driving wheel components may be disposed opposite to and spaced from each other and provided on two opposite sides of a bottom of the bullet collecting device respectively.

In some embodiments, each of the differential driving wheel components may comprise a traveling wheel, a wheel axle and a chassis motor, wherein the chassis motor may be fixedly connected with the traveling wheel through the wheel axle and drives the traveling wheel to rotate.

In some embodiments, each of the differential driving wheel components may further comprise a motor base that may be a U-shaped structure with two support arms. The wheel axle may drivably pass through one of the support arms of the motor base, while the chassis motor may be fixedly connected with the other support arm of the motor base. A driving shaft of the chassis motor may rotatably pass through the other support arm of the motor base and be fixedly connected with the wheel axle; a bottom of the motor base may be fixedly connected with the bottom of the bullet collecting device.

In some embodiments, each of the differential driving wheel components may further comprise a coupling, which may comprise an upper housing portion with an upper mounting groove and a lower housing portion with a lower mounting groove, wherein the upper housing portion may be detachably spliced with the lower housing portion, and the upper mounting groove and the lower mounting groove may together form a connecting axle hole, within which an end of the wheel axle and the driving shaft of the chassis motor may be fixed.

In some embodiments, the connecting axle hole may be a stepped hole, and the stepped hole may comprise a large hole portion and a small hole portion in communication with the large hole portion, wherein at least one of the upper housing portion and the lower housing portion may be provided with a pin hole thereon in communication with the large hole portion, and an end of the wheel axle which may be inserted into the large hole portion of the connecting axle hole may be provided with a fixing hole. The fixing hole may correspond to the pin hole and is configured for a limiting pin to pass through.

In some embodiments, each of the differential driving wheel components may further comprise a bearing mounted within a through-hole provided for the wheel axle to pass through on one of the support arms of the motor base, wherein the wheel axle may pass through the bearing.

In some embodiments, the travel driving mechanism may further comprise two universal wheels, wherein the two universal wheels may be disposed opposite to and spaced from each other and mounted on the bottom of the bullet collecting device.

In some embodiments, the two differential driving wheel components may be provided at the front of the bottom of the bullet collecting device, while the two universal wheels may be provided at the back of the bottom of the bullet collecting device, so as to form a forward drive traveling mechanism.

In some embodiments, the travel driving mechanism may further comprise two guiding wheels, wherein the two guiding wheels may be disposed opposite to and spaced from each other and mounted at the front of the bottom of the bullet collecting device, and the two differential driving wheel components may be provided at the back of the bottom of the bullet collecting device, so as to form a backward drive traveling mechanism.

In some embodiments, the bullet collecting robot may further comprise a bullet supply device which may be configured to output the bullets within the bullet accommodating cavity.

In some embodiments, the bullet supply device may comprise a supply motor, a rotary disk and a output track, wherein the supply motor drives the rotary disk to rotate, and the rotary disk is provided with a push plate radially extending along the rotary disk. In some embodiments, one end of the output track may extend out of the bullet collecting device and the other end of the output track may be joined with an edge of the rotary disk, and the output track may be provided with a slide slot for rolling of the bullets;

In some embodiments, the push plate may push the bullets on the rotary disk along with a rotation of the rotary disk, allowing the bullets to be pushed into the slide slot of the output track, and the bullets may roll outside of the bullet collecting device along the slide slot under the force of their own gravity.

In some embodiments, the bottom of the bullet accommodating cavity may be provided with a valve mechanism for rolling out of the bullets, and the bullet supply device may comprise a supply driving device and a plurality of bullet cartridges, wherein the supply driving device may comprise a driving cylinder and a push rod fixedly connected with a retractable rod of the driving cylinder and configured to push the bullet cartridges; the bullet cartridges may be mounted below the bullet accommodating cavity, and when one of the bullet cartridges is filled with bullets, the supply driving device may push the bullet cartridge filled with bullets out of the bullet collecting device and push an empty bullet cartridge just below the valve mechanism.

DETAILED DESCRIPTION OF THE PRESENT DISCLOSURE

Figure 1:
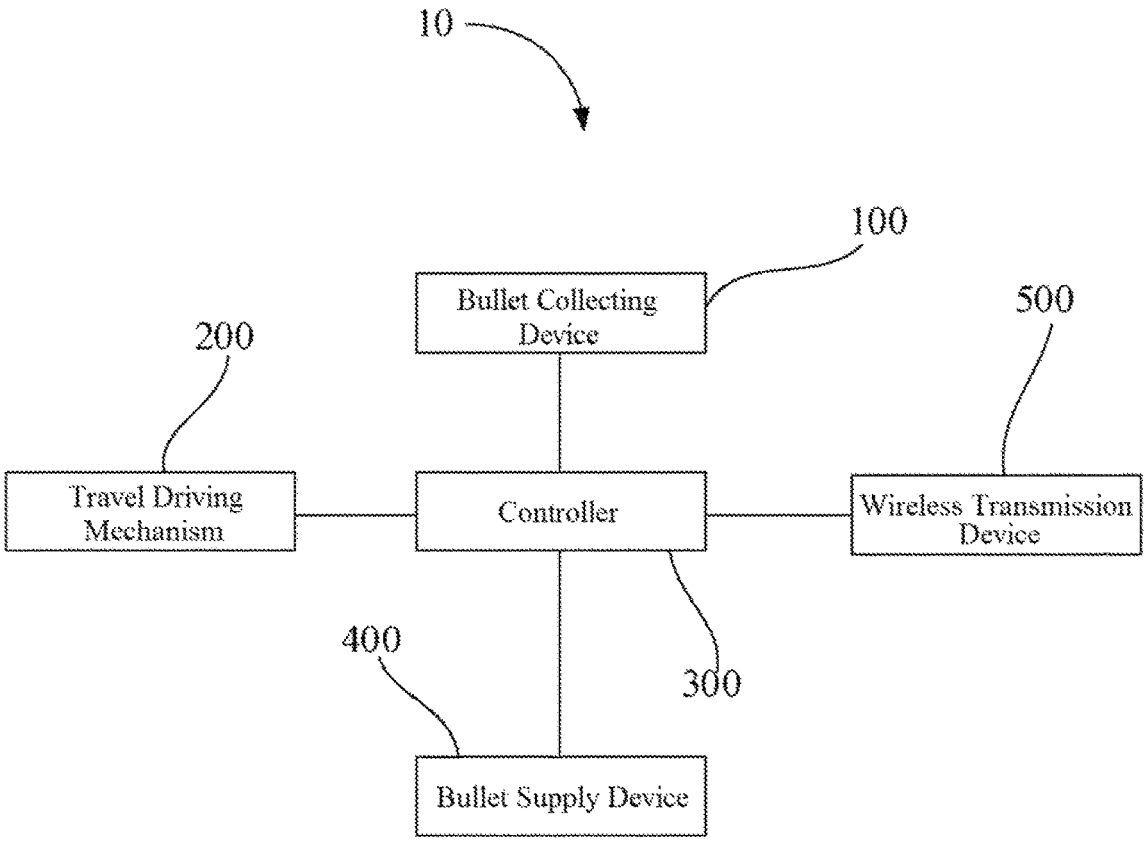
FIG. 1 is a principle diagram of a bullet collecting robot according to an embodiment of the present disclosure.

The technical solutions of the present disclosure will be described clearly and completely below in combination with the drawings in the embodiments of the present disclosure. It should be apparent that embodiments described herein are only a part rather than all of the embodiments of the present disclosure. All other embodiments obtained by those having ordinary skills in the art on the basis of the embodiments of the present disclosure without any inventive efforts should fall within the protection scope of the present disclosure.

It is explained that, when a component is referred to be "fixed on" another component, it may be directly on another component or there may be an intermediate component therebetween. When a component is considered to be "connected with" another component, it may be directly connected with another component or there may be an intermediate component simultaneously. Terms such as "vertical," "horizontal," "left," "right," and the like used herein are merely for illustrative purposes.

Unless otherwise defined, all the technical and scientific terms used herein have the same meaning as those skilled in the technical field that the present disclosure belongs to can understand generally. The terms used herein in the specification of the present disclosure are only intended to describe specific embodiments rather than to limit the present disclosure. The term "and/or" used herein includes any and all of the combinations of one or more related items listed.

An embodiment of the present disclosure discloses a bullet collecting robot. The bullet collecting robot may comprise a bullet collecting device configured to pick up bullets automatically and a travel driving mechanism configured to drive the bullet collecting device to move. The bullet collecting device may be moved to different areas by the travel driving mechanism, thereby collecting bullets in different areas.

The bullet collecting device may comprise a collection bin configured to hold collected bullets, a friction roller configured to roll the bullets so as to draw the bullets into the collection bin, and a collection driving member configured to drive the friction roller to rotate.

In some embodiments, the friction roller may be an elastic roller which may present elastic deformation when rolling the bullets to increase a frictional force between the friction roller and the bullets, so as to easily draw the bullets into the collection bin.

For example, the friction roller may comprise an inner tube and a sponge sleeve that may be fixedly sleeved on the inner tube and may present deformation when squeezed with the bullets. Alternatively, the friction roller may be a rubber roller which may present elastic deformation when squeezed with the bullets.

In some embodiments, the collection driving member may be a brushless or brush motor which may be coaxially connected with an end portion of the friction roller.

In some embodiments, the friction roller may have a hollow shaft within which a driving shaft of the motor may be received. The friction roller may be a solid shaft which may be coaxially connected with the driving shaft of the motor.

In some embodiments, the collection bin may be provided with a bullet accommodating cavity and a slope surface therewithin, and the slope surface is extended into the bullet accommodating cavity and provided for rolling of the bullets. The bullets may be allowed to roll into the bullet accommodating cavity of the collection bin along the slope surface, and sundries rolling with the bullets would slide out of the collection bin along the slope surface, allowing for a function of filtering sundries.

In some embodiments, the collection bin may be provided with a collection opening. There may be a plurality of collection openings disposed around the periphery of the collection bin, and one or more friction rollers may be disposed at each of the collection openings, such that the bullet collecting device may collect bullets in any direction.

In some embodiments, a plurality of adjacent friction rollers may share one collection driving member, for example, each of the collection driving member may drive two adjacent friction rollers to rotate simultaneously by a transmission mechanism.

In some embodiments, the bullet collecting device may further comprise a bullet classifying mechanism configured to separate different types of bullets.

In some embodiments, the travel driving mechanism may be a differential chassis mechanism, which may comprise two differential driving wheel components. The two differential driving wheel components may be disposed opposite to and spaced from each other and provided on two opposite sides of the bottom of the collection bin respectively.

In some embodiments, the bullet collecting robot may further comprise a bullet supply device, which may be connected in communication with a controller, and configured to output the bullets within the bullet accommodating cavity.

The embodiments of the present disclosure further provide a shooting game system based on the foregoing bullet collecting robot.

The shooting game system may comprise a plurality of remotely controlled chariots and at least one foregoing bullet collecting robot. The plurality of remotely controlled chariots may fire bullets and be divided into two sides of the game to play the shooting dual meet. The bullet collecting robot may be capable of being joined with the remotely controlled chariot to be supplied and providing bullet supply.

In some embodiments, the bullet collecting robot may collect different types of bullets and provide bullet supply for the chariots of both sides of the game. For example, the bullet collecting robot may move within a preset bullet supply area, and provide bullet supply for the remotely controlled chariots which enter into the bullet supply area.

In some embodiments, the bullet collecting robot may recognize both sides of the game and provide bullet supply only for the remotely controlled chariots of its own side. For example, there may be a plurality of bullet collecting robots which may have been divided into two teams providing bullet supply for the remotely controlled chariots of two sides respectively; the remotely controlled chariot may transmit a request signal for bullet supply automatically when the number of its current remaining bullets is less than a preset number of bullets. When a bullet collecting robot receives the request signal for bullet supply from the remotely controlled chariot of its own side, it may follow the remotely controlled chariot around automatically to provide bullet supply.

Some embodiments of the present disclosure will be described in detail below with reference to the accompanying drawings.

Figure 2:
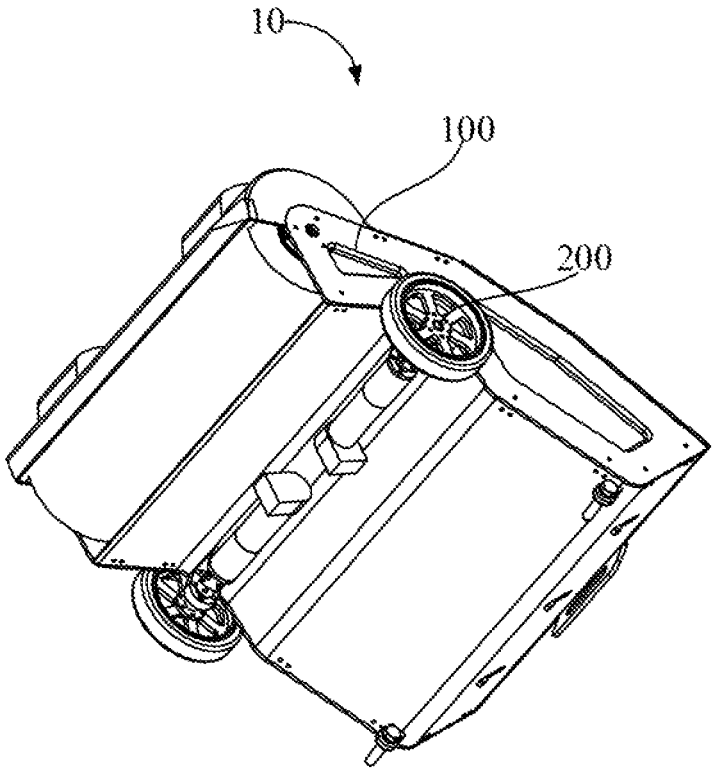
FIG. 2 is a structure diagram of the bullet collecting robot shown in FIG. 1.

Referring to FIGS. 1 and 2, a bullet collecting robot 10 according to an embodiment of the present disclosure may comprise a bullet collecting device 100, a travel driving mechanism 200 and a controller 300. The travel driving mechanism 200 may be configured to drive the bullet collecting device 100 to move. The controller 300, which may be connected in communication with the bullet collecting device 100 and the travel driving mechanism 200, may be configured to control the bullet collecting device 100 and the travel driving mechanism 200.

Figure 3:
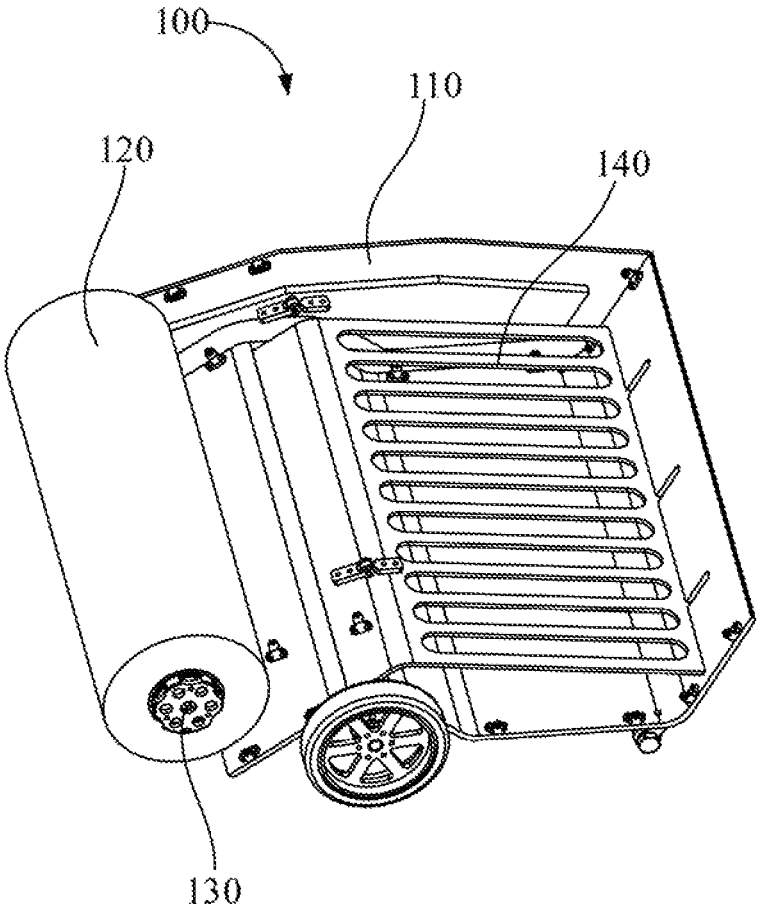
FIG. 3 is a structure diagram of the bullet collecting robot shown in FIG. 2 without an upper cover, a protective shield and one of side plates.

Referring to FIG. 3, a bullet collecting device 100 may comprise a collection bin 110, a friction roller 120 and a collection driving member 130. The collection bin 110 may be configured to hold collected bullets. The friction roller 120 may be configured to pick up bullets. The collection driving member 130 may be configured to drive the friction roller 120 to rotate.

Figure 4:
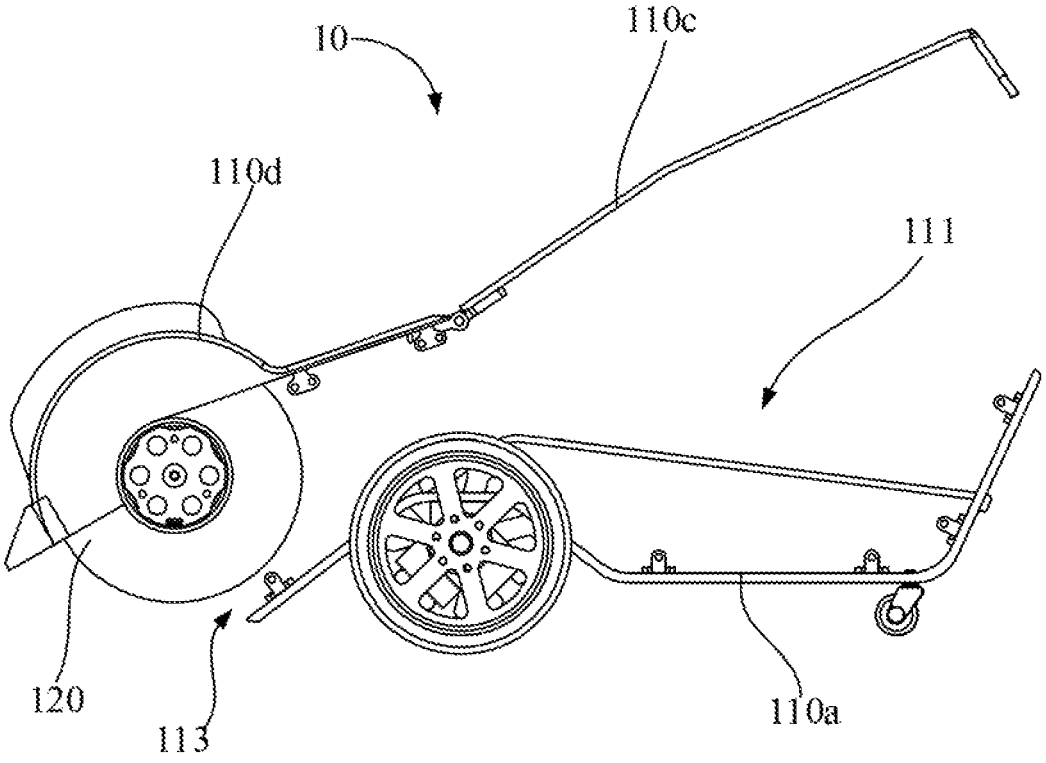
FIG. 4 is a structure diagram of the bullet collecting robot shown in FIG. 2 without the side plates.
Figure 5:
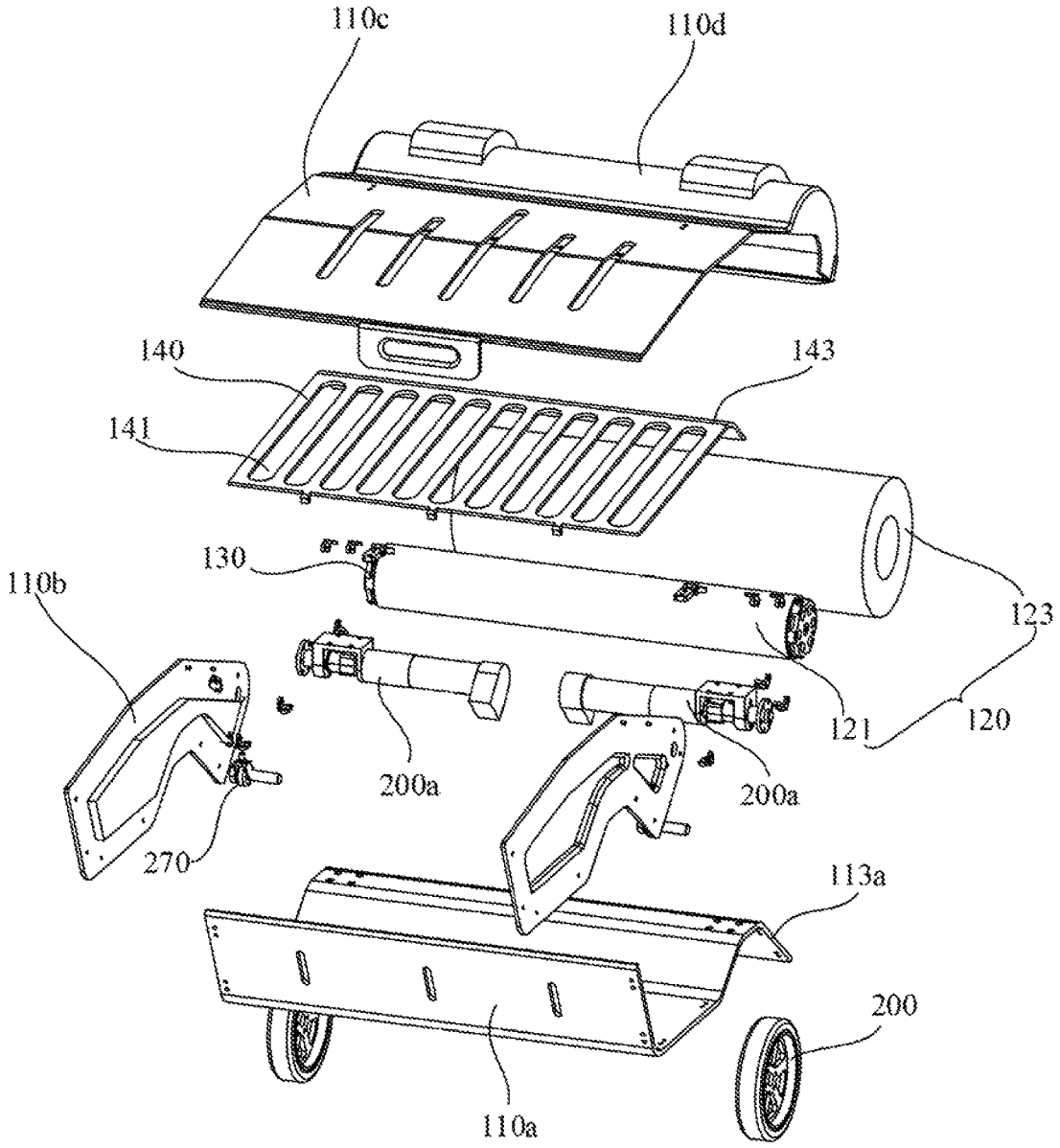
FIG. 5 is an exploded view of the bullet collecting robot shown in FIG. 2.
Figure 6:
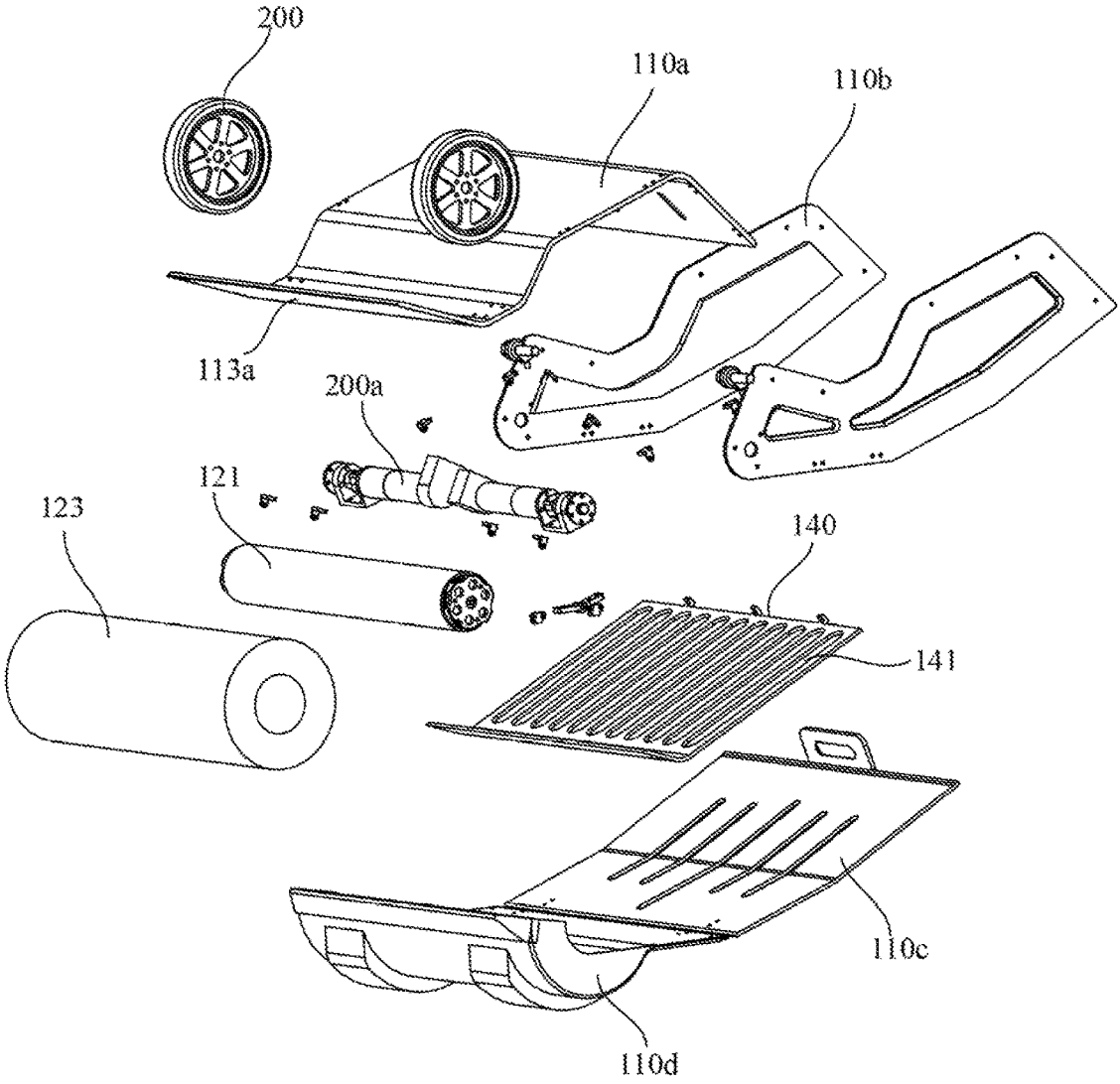
FIG. 6 is an exploded view from another perspective of the bullet collecting robot shown in FIG. 2.
Figure 7:
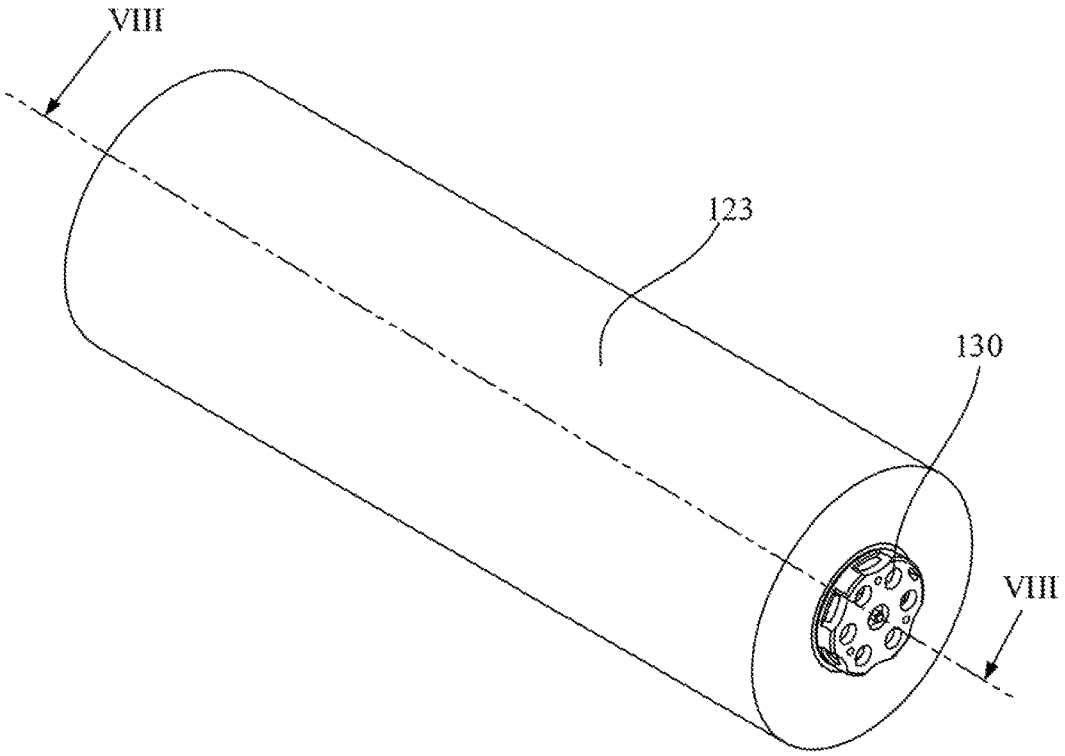
FIG. 7 is a structure diagram of a collection driving member fitted with a rolling wheel of the bullet collecting robot shown in FIG. 2.
Figure 8:
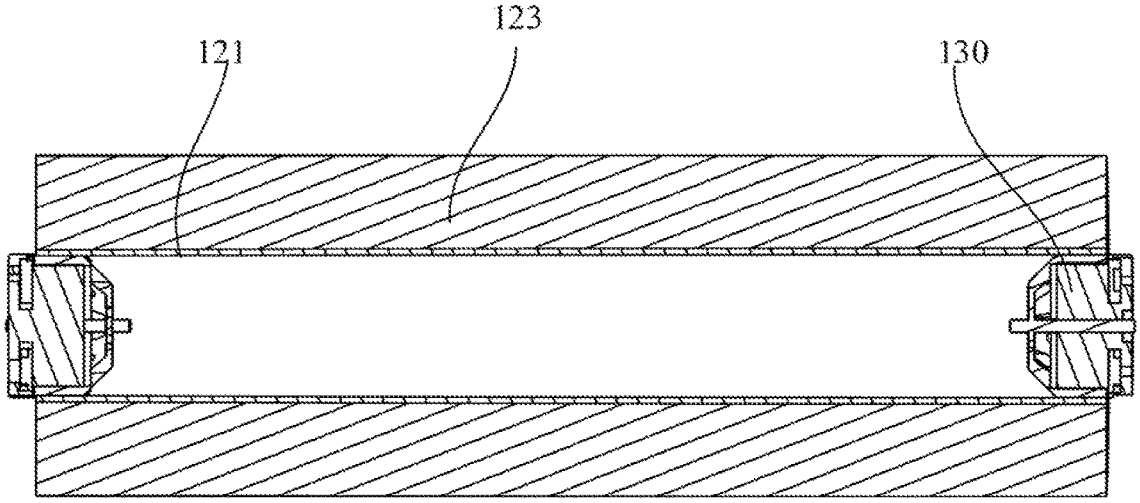
FIG. 8 is a cross sectional view taken along a line VIII-VIII in FIG. 7.
Figure 9:
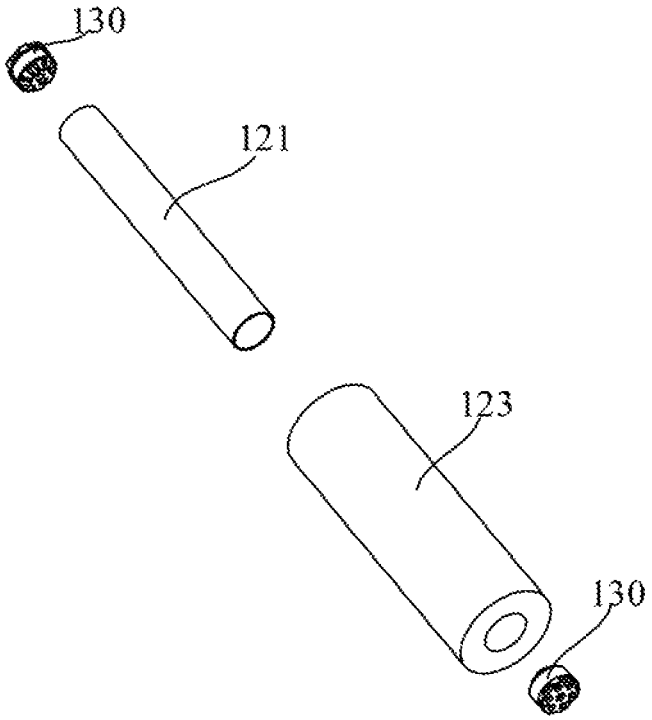
FIG. 9 is a perspective view of the collection driving member fitted with the rolling wheel shown in FIG. 7.
Figure 10:
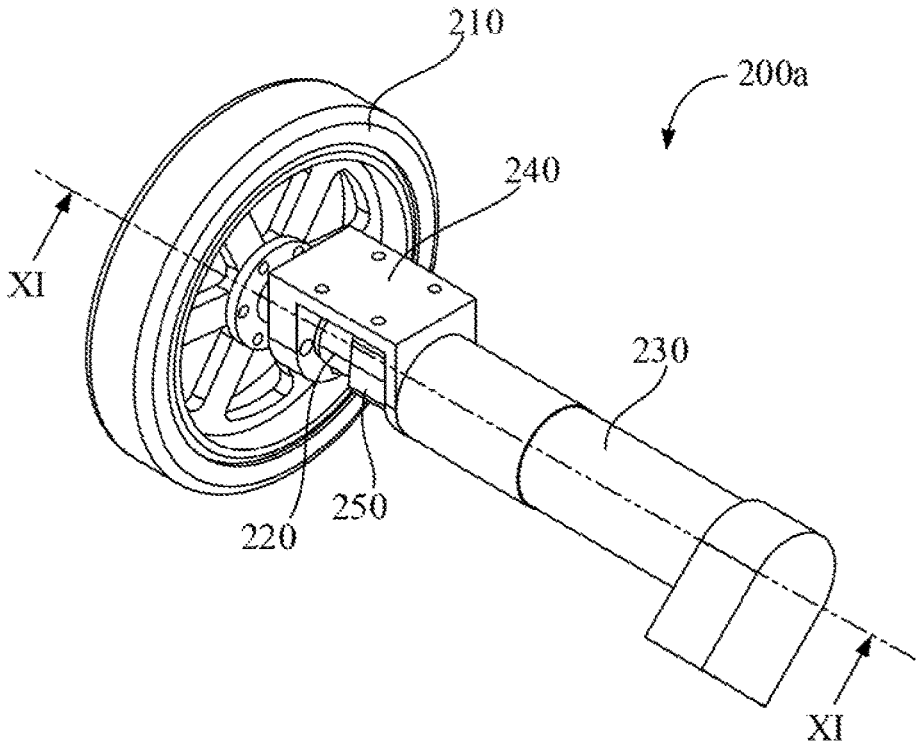
FIG. 10 is a perspective view of a travel driving mechanism of the bullet collecting robot shown in FIG. 2.
Figure 11:
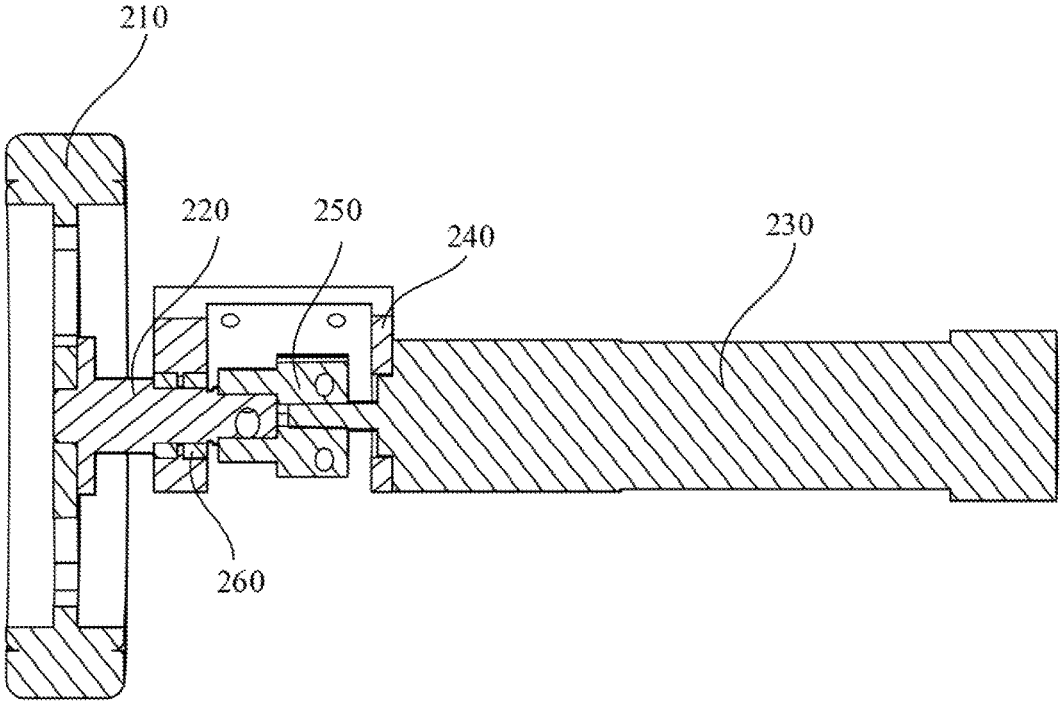
FIG. 11 is a cross sectional view taken along a line XI-XI in FIG. 10; 10075
Figure 12:
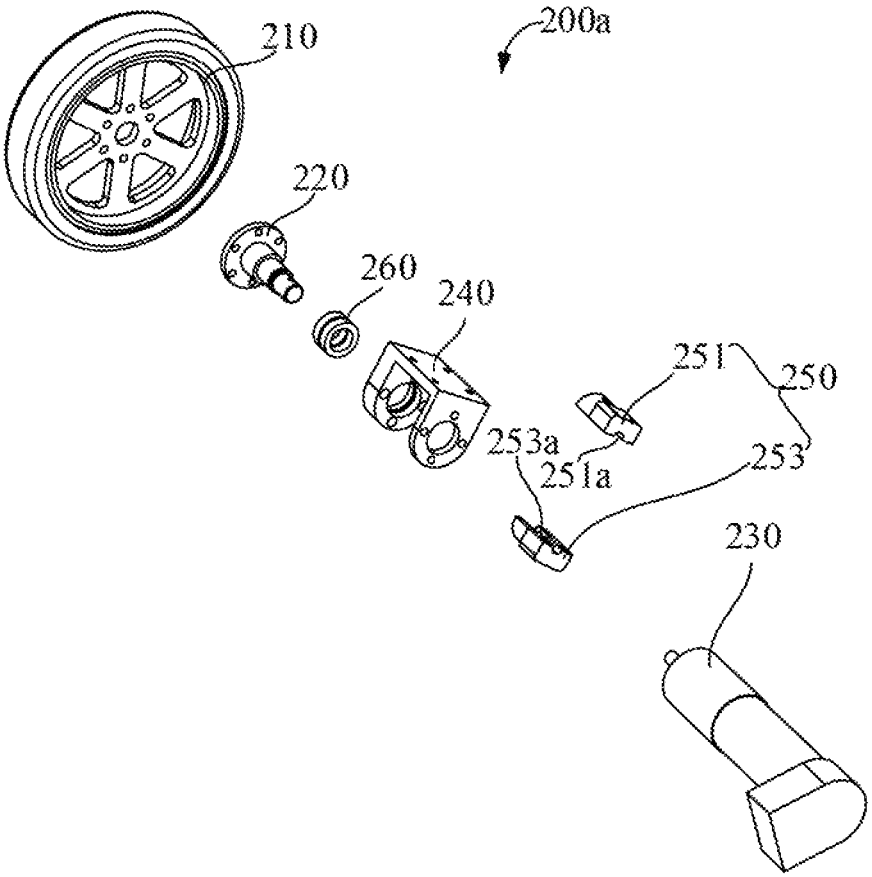
FIG. 12 is an exploded view of the travel driving mechanism shown in FIG. 10.
Figure 13:
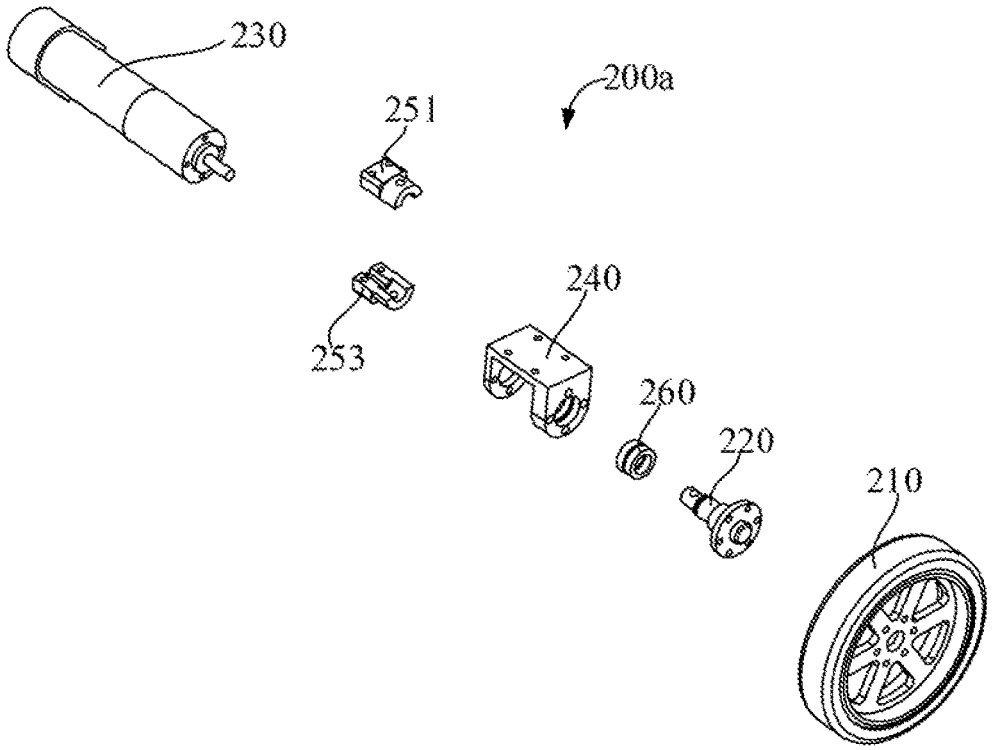
FIG. 13 is an exploded view from another perspective of the travel driving mechanism shown in FIG. 10.

Referring to FIGS. 4 to 6 at the same time, the collection bin 110 may be provided with a bullet accommodating cavity 111 and a collection opening 113 in communication with the bullet accommodating cavity 111, and an inner wall of the collection opening 113 may be provided with a collection surface 113*a* for rolling of bullets.

The number of collection opening 113 may be configured depending on different needs. For example, in the illustrated embodiment, there may be one collection opening 113 provided at an end of the collection bin 110.

In some embodiments, there may be a plurality of collection openings 113. For example, in other embodiments, the collection bin 110 may be a rounded shell structure with a plurality of collection openings 113 disposed around the periphery of the collection bin 110, and there may be a plurality of friction rollers 120 disposed corresponding to the plurality of collection openings 113 respectively. Since the plurality of the collection openings 113 are disposed around the periphery of the collection bin 110, bullets may be easily collected in any directions.

A specific structure of the collection bin 110 may be designed depending on different needs. For example, in the illustrated embodiment, the collection bin 110 may comprise a baseplate 110*a*, two side plates 110*b*, an upper cover 110*c* and a protective shield 110*d*. The upper cover 110*c* may be disposed opposite to the baseplate 110*a*, and one end of the upper cover 110*c* may be connected with one end of the baseplate 110*a* while the other end of the upper cover 110*c* may be connected with the protective shield 110*d*. The two side plates 110*b* may be disposed opposite to and spaced from each other, and fixedly connected with the baseplate 110*a* and two opposite sides of the protective shield 110*d* respectively. The protective shield 110*d* and an end of the baseplate 110*a* that is distal from the upper cover 110*c* may together form the collection opening 113. The collection surface 113*a* may be provided on the baseplate 110.

Further, an end of the upper cover 110*c* may be detachably connected with an end of the baseplate 110*a*, while the other end may be rotatably connected with the protective shield 110*d*. When the upper cover 110*c* is opened, the collected bullets can be taken out easily from the collection bin 110.

Further, the collection surface 113*a* may be a rising slope surface through which the bullets may roll into the bullet accommodating cavity 111. As the bullets roll into the bullet accommodating cavity 111 through the rising slope surface, sundries rolling with the bullets into the collection opening 113 would automatically slide out of the collection bin 110 along the rising slope surface; thereby those sundries caught by the friction roller 120 may be filtered.

The shape of the slope surface may be designed depending on different needs. For example, in the illustrated embodiment, the slope surface is a flat surface. In some other embodiments, the collection surface 113*a* may also be an arc-shaped surface.

Further, the collection surface 113*a* may be provided with a buffer layer (not shown) thereon to reduce a noise resulting from the impact between the collection surface 113*a* and the bullets when the bullets are being caught into the collection bin 110. For example, a sponge pad for buffer may be adhered to the collection surface 113*a* to reduce the noise.

The friction roller 120 may be provided at the collection opening 113 of the collection bin 110 and rotatable freely. A rotation shaft of the friction roller 120 may be disposed opposite to and spaced from the collection surface 113*a* of the collection bin 110. For example, in the illustrated embodiment, the rotation shaft of the friction roller 120 may be disposed in parallel with the collection surface 113*a*, creating a preset gap between a peripheral surface of the friction roller 120 and the collection surface 113*a* of the collection bin 110. In some embodiments, the rotation shaft of the friction roller 120 may be disposed obliquely relative to the collection surface 113*a*, making the preset gap uneven or special-shaped.

A specific structure of the friction roller 120 may be designed depending on different needs. For example, as shown in FIGS. 5 to 9, in the illustrated embodiments, the friction roller 120 may comprise an inner tube 121 and a sponge sleeve 123 that may be fixedly sleeved on the inner tube 121. In some embodiments, the inner tube 121 as well as the sponge sleeve 123 may be of cylindrical structure.

The inner tube 121 may be made from a material with a light weight and a high structural strength. For example, the inner tube 121 may be a carbon fiber tube.

In other embodiments, the friction roller 120 may comprise a stationary shaft and a rubber roller that may be fixedly sleeved on the stationary shaft. The stationary shaft may be made from a material with good rigidity. For example, the stationary shaft may be a steel shaft so as to increase the structural strength of the entire friction roller 120.

In another embodiment, the friction roller 120 may comprise a rubber roller and two stationary shafts that may be fixed on two ends of the rubber roller respectively and disposed coaxially with the rubber roller.

The collection driving member 130 may be connected with the friction roller 120. In some embodiments, when the bullets are located outside of the friction roller 120, the collection driving member 130 may drive the friction roller 120 to rotate such that the bullets may be caught into the collection opening 113 from the preset gap and roll into the bullet accommodating cavity 111 along the collection surface 113*a*.

The collection driving member 130 may be a brushless motor or a brush motor. For example, in the illustrated embodiments, the collection driving member 130 may be a brushless motor, and a rotor of the brushless motor may be received within an opening end of the inner tube 121 and fixedly connected with the opening end of the inner tube 121 such that the inner tube 121 may rotate together with the rotor of the brushless motor. Due to the noise resulting from the high-speed rotation of the brushless motor, the rotor of the brushless motor may be received within the opening end of the inner tube 121, such that the brushless motor can be enveloped inside so as to reduce the outside-spreading sound.

In some other embodiments, the collection driving member 130 may be a brush motor, and a driving shaft of the brush motor may be coaxially and fixedly connected with the stationary shaft.

The number of the collection driving member 130 may be set depending on different needs. For example, in the illustrated embodiment, there may be two collection driving members 130 which may be fixed on the two side plates 110*b* respectively, and drive two ends of the friction roller 120 respectively.

In some embodiments, there also may be one collection driving member 130 that may be connected with one end of the friction roller 120, and the other end of the friction roller 120 may be rotatably connected with one of the side plates 110*b*.

In addition, when there is a plurality of friction rollers 120, there may be a plurality of the collection driving members 130, and each of the collection driving members 130 may drive simultaneously two adjacent friction rollers 120 to rotate by a transmission mechanism. In some embodiments, the transmission mechanism may comprise at least one of the followings: a worm gear and worm transmission mechanism, a helical gear set transmission mechanism and a belt transmission mechanism.

For example, if the transmission mechanism is a worm gear and worm transmission mechanism, the opposite ends of the two adjacent friction rollers may be connected with the worm gear, while the collection driving member 130 may be connected with the worm and drive the worm to rotate together; the worm may engage with two worm gears and thereby drive the two worm gears to rotate simultaneously, and each of the worm gears may drive its corresponding friction roller 120 to rotate.

If the transmission mechanism is a helical gear set transmission mechanism, the helical gear set transmission mechanism may comprise two driven helical gears and a driving helical gear. The two driven helical gears may be connected respectively with each end portion of the opposite ends of the two adjacent friction rollers 120; the collection driving member 130 may be connected with the driving helical gear and drive the driving helical gear to rotate; the driving helical gear may engage with the two driven helical gears simultaneously and thereby drive the two driven helical gears to rotate, and each of the driven helical gears may drive its corresponding friction roller 120 to rotate.

If the transmission mechanism is a belt transmission mechanism, there may be two belts, one of which may be sleeved on the rotation shaft of one of the friction rollers 120 and the driving shaft of the collection driving member 130, while the other one of which may be sleeved on the rotation shaft of the other friction roller 120 and the driving shaft of the collection driving member 130. The driving shaft of the collection driving member 130 may drive the two friction rollers 120 to rotate simultaneously by the two belts.

Further, as shown in FIG. 5, the bullet collecting device 100 may further comprise a bullet classifying mechanism 140 configured to separate different types of bullets. The bullet classifying mechanism 140 may be mounted within the collection bin 110.

A specific structure of the bullet classifying mechanism 140 may be designed depending on different needs. For example, in the illustrated embodiment, the bullet classifying mechanism 140 may be a partition plate which may be mounted at the entrance of the bullet accommodating cavity ill, and may be provided with a hollowed-out filter groove 141 thereon.

Further, the number and shape of the filter groove 141 may be designed depending on different situations. For example, in the illustrated embodiment, there may be a plurality of filter grooves 141, and each of the filter grooves 141 may be a long and narrow groove.

Further, the partition plate may be disposed obliquely, allowing the bullets which did not pass through the filter groove 141 to roll along the partition plate under the force of their own gravity. As the bullets may roll along the partition plate under the force of their own gravity, no additional transmission device would be needed to transmit the bullets.

Figure 14:
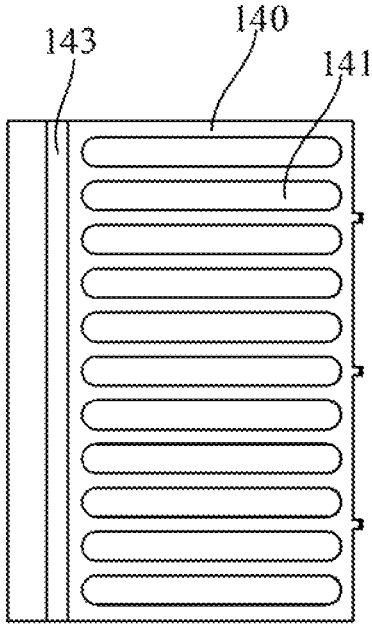
FIG. 14 is a top view of a partition plate of the bullet collecting robot shown in FIG. 2.

Further, as shown in FIGS. 5 and 14, one end of the partition plate close to the entrance of the bullet accommodating cavity 111 may have a bending portion 143 so as to form a V-shaped limiting rib, and the bullets may climb over the limiting rib to get into the area where the filter groove 141 is located.

In some embodiments, the bullet classifying mechanism 140 may also be other structures. For example, in some other embodiments, the bullet classifying mechanism 140 may comprise a main pipe and a plurality of branch pipes. The main pipe may be provided with a channel therein with a V-shaped cross section, and the plurality of branch pipes may be in communication with the main pipe and corresponding to different widths of the main pipe respectively, and the bullets of different sizes may roll along areas with different widths in the channel of the main pipe.

In the foregoing embodiment, as the channel of the main pipe has a V-shaped cross section, the bullets of different sizes may roll at different locations; thereby the bullets of different sizes can be filtered and then collected with the corresponding branch pipes.

The travel driving mechanism 200 may be a differential-wheel chassis mechanism, four-wheel omni-directional chassis mechanism or three-wheel omni-directional chassis mechanism and the like. As shown in FIG. 5, in the illustrated embodiment, the travel driving mechanism 200 may comprise two differential driving wheel components 200*a*. The two differential driving wheel components 200*a* may be disposed opposite to and spaced from each other and provided on two opposite sides of the bottom of the collection bin 110 respectively.

Referring to FIGS. 10 to 13, each of the differential driving wheel components 200*a* may comprise a traveling wheel 210, a wheel axle 220 and a chassis motor 230. The chassis motor 230 may be fixedly connected with the traveling wheel 210 through the wheel axle 220 and drive the traveling wheel 210 to rotate.

Further, each of the differential driving wheel components 200*a* may further comprise a motor base 240. Specifically in the illustrated embodiment, the motor base 240 may be a U-shaped structure with two support arms, and the wheel axle 220 may drivably pass through one of the support arms of the motor base 240, while the chassis motor 230 may be fixedly connected with the other support arm of the motor base 240. A driving shaft of the chassis motor 230 may rotatably pass through the other support arm of the motor base 240 and fixedly is connected with the wheel axle 220. The bottom of the motor base 240 may be fixedly connected with the bottom of the collection bin 110.

Further, each of the differential driving wheel components 200*a* may further comprise a coupling 250, which may comprise an upper housing portion 251 with an upper mounting groove 251*a* and a lower housing portion 253 with a lower mounting groove 253*a*. The upper housing portion 251 may be detachably spliced with the lower housing portion 253, and the upper mounting groove 251*a* and the lower mounting groove 253*a* may together form a connecting axle hole, within which one end of the wheel axle 220 and the driving shaft of the chassis motor 230 may be fixed.

The shape of the connecting axle hole of the coupling 250 may be designed depending on different needs. For example, in the illustrated embodiment, the connecting axle hole of the coupling 250 may be a stepped hole, and the stepped hole may comprise a large hole portion and a small hole portion in communication with the large hole portion. At least one of the upper housing portion 251 and the lower housing portion 253 may have a pin hole thereon in communication with the large hole portion, and an end of the wheel axle 220, which is inserted into the large hole portion of the connecting axle hole, may be provided with a fixing hole corresponding to the pin hole for a limiting pin to pass through.

Further, each of the differential driving wheel components 220*a* may further comprise a bearing 260 mounted within a through-hole provided for the wheel axle 220 to pass through on one of the support arms of the motor base 240. The wheel axle 220 may pass through the bearing 260.

Further, as shown in FIG. 5, the travel driving mechanism 200 may further comprise two universal wheels 270. The two universal wheels 270 may be disposed opposite to and spaced from each other and mounted on the bottom of the collection bin 110.

The two differential driving wheel components 200*a* may form a forward drive traveling structure or a backward drive traveling mechanism. Specifically in the illustrated embodiment, the two differential driving wheel components 200*a* may be provided at the front of the bottom of the collection bin 110, while the two universal wheels 270 may be provided at the back of the bottom of the collection bin 110, so as to form a forward drive traveling mechanism.

In some other embodiments, the travel driving mechanism 200 may further comprise two guiding wheels. The two guiding wheels may be disposed opposite to and spaced from each other and mounted at the front of the bottom of the collection bin 110, while the two differential driving wheel components 200*a* may be provided at the back of the bottom of the collection bin 100, so as to form a backward drive traveling mechanism.

Further, referring to FIG. 1 again, in order to provide the bullet collecting robot 10 with a function of bullet supply, the bullet collecting robot 10 may further comprise a bullet supply device 400, which may be connected in communication with the controller 300, configured to output the bullets within the bullet accommodating cavity 111.

The bullet supply device 400 may supply bullets in bulk or in cartridge. In some embodiments, the bullet supply device 400 may comprise a supply motor, a rotary disk and an output track. The rotary disk, which may have a push plate radially extending along the rotary disk, may be driven by the supply motor to rotate. One end of the output track may extend out of the collection bin 110 while the other end may be joined with the edge of the rotary disk, and the output track may be provided with a slide slot for rolling of the bullets. In some embodiments, the push plate may push the bullets on the rotary disk as the rotary disk rotates, allowing the bullets to be pushed into the slide slot of the output track, and the bullets may roll out of the collection bin 110 along the slide slot under the force of their own gravity.

In some other embodiments, the bottom of the bullet accommodating cavity 11 may be provided with a valve mechanism for rolling out of the bullets, and the bullet supply device 400 may comprise a supply driving device and a plurality of bullet cartridges. The supply driving device may comprise a driving cylinder as well as a push rod fixedly connected with a retractable rod of the driving cylinder and configured to push the bullet cartridges. The bullet cartridges may be mounted below the bullet accommodating cavity 111, and when one of the bullet cartridges is filled with bullets, the supply driving device may push the bullet cartridge filled with bullets out of the collection bin 110 and push an empty one just below the valve mechanism.

Further, in order for the foregoing bullet collecting robot 10 to be capable of supplying bullets automatically for an external device to be supplied, the bullet collecting robot 10 may comprise a wireless transmission device 500 connected in communication with the controller 300 and configured to receive and transmit wireless signals. The controller 300 may accept a request signal for bullet supply from the external device to be supplied and transmit a signal of being ready for bullet supply via the wireless transmission device 500.

When a bullet collecting robot 10 encounters bullets (for example, flash balls or golf balls fired as bullets) on the ground ahead, a friction roller 120 in the front of the bullet collecting robot 10 may rotate with a high speed to catch the bullets or shells into a collection bin 110 and into a bullet accommodating cavity 111 of the collection bin 110 across a collection surface 113*a*. The collection bin 110 of the bullet collecting robot 10 may be provided with a bullet classifying mechanism 140 (a partition plate), and a filter groove 141 may be provided in the middle of the partition plate. The partition plate may classify the bullets automatically: the flash balls may pass through the filter groove 141 onto the bottom of the collection bin 110, while the golf balls may be unable to pass through the filter groove 141 due to its larger diameter and stay on an upper layer of the partition plate. Automatic bullet classification may be realized by the hollowed-out partition plate. After recycling, an upper cover 110*c* may be opened and the golf balls may be taken out. After taking all of the golf balls out, the partition plate may be removed and the underlying flash balls may be taken out.

Compared to a traditional technique, the foregoing bullet collecting robot 10 may have at least the following advantages:

(1) The foregoing bullet collecting device 100 may drive the rotation of the friction roller 120 through the collection driving member 130, such that the bullets may be caught by the friction roller 120 into the collection opening 113 from the preset gap and roll into the bullet accommodating cavity 111 along the collection surface 113*a*; thereby it may be easy to collect bullets on the ground.

(2) The foregoing bullet collecting device 100 may allow, by use of the friction roller 120, the bullets to be caught into the collection opening 113 from the preset gap and to roll into the bullet accommodating cavity 111 along the collection surface 113*a*, whereas other objects with a particle diameter less than the preset gap between the peripheral surface of the friction roller 120 and the collection surface 113*a* would leak from the collection opening 113 automatically, for example, sundries on the ground with a particle diameter less than the preset gap may not be caught into the collection bin 110 by the friction roller 120, thus the bullet collecting device 100 may be able to collect bullets selectively.

(3) The travel driving mechanism 200 of the foregoing bullet collecting robot 10 may utilize a differential-wheel chassis. Two driving wheels may be provided at the middle of the bullet collecting robot 10 and two driven wheels (universal wheels 270) may be provided at the back. The differential wheel train may need only two driving motors, which may save a lot of cost compared to a three-wheel omni-directional chassis or four-wheel omni-directional chassis.

(4) The travel driving mechanism 200 of the foregoing bullet collecting robot 10 may utilize a differential-wheel chassis, which may save more space than a three-wheel or four-wheel omni-directional chassis and spare more space to store the recycled bullets.

The present disclosure may further provide a shooting game system based on the foregoing bullet collecting robot 10.

Figure 15:
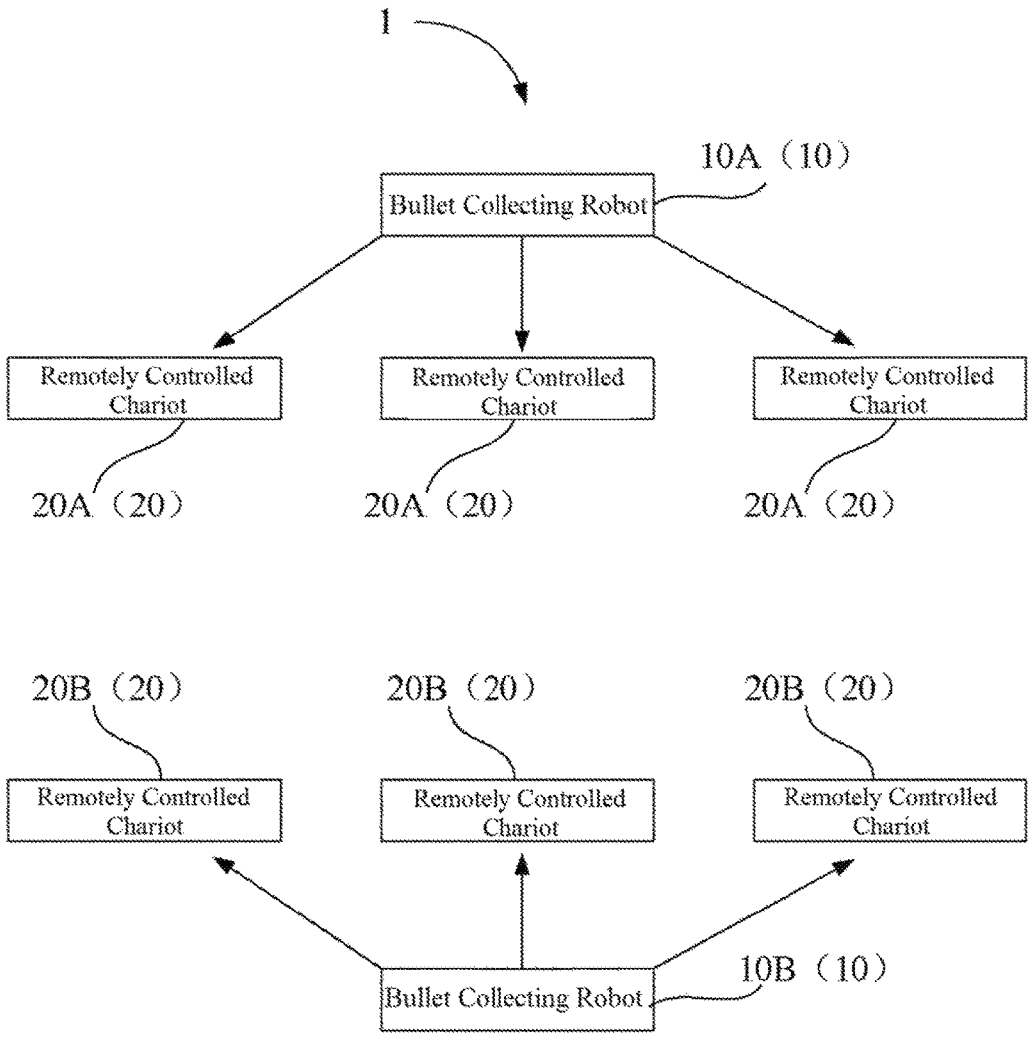
FIG. 15 is a schematic diagram of a shooting game system according to an embodiment of the present disclosure.

Referring to FIG. 15, the shooting game system 1 of the embodiment of the present disclosure may comprise a foregoing bullet collecting robot 10 and a plurality of remotely controlled chariots 20 capable of firing bullets. The plurality of remotely controlled chariots 20 may be divided into both sides of the games, i.e., remotely controlled chariots 20A and remotely controlled chariots 208. The bullet collecting robot 10 may be capable of automatically joining with a remotely controlled chariot 20 to be supplied and providing bullet supply. The specific structure of the bullet collecting robot 10 is as described above and would not be described again herein.

The bullet collecting robot 10 may play a role as a medic in the shooting game system 1, and its way of bullet supply may be designed depending on different needs. For example, there may be a plurality of bullet collecting robots 10. They may be assigned to the two sides of the game, respectively, i.e., bullet collecting robots 10A and bullet collecting robots 10B, and the bullet collecting robots 10 of each side may provide bullet supply for the remotely controlled chariots 20 of their own side; alternatively, there may be one or more bullet collecting robots 10 providing bullet supply for all of the remotely controlled chariots 20.

In the illustrated embodiment, there may be a plurality of bullet collecting robots 10 which may be divided into two teams for providing bullet supply for the remotely controlled chariots 20 of both sides respectively; a remotely controlled chariot 20 may transmit a request signal for bullet supply automatically when the number of its current remaining bullets is less than a preset number of bullets. When a bullet collecting robot 10 receives the request signal for bullet supply from the remotely controlled chariot 20 of its own side, it may follow the remotely controlled chariot 20 around automatically to provide bullet supply.

In some other embodiments, the bullet collecting robot 10 may move within a preset bullet supply area and provide bullet supply for the remotely controlled chariots 20 which entered into the bullet supply area.

In the several embodiments provided by the present disclosure, it should be appreciated that the disclosed related device and method may be implemented in other ways. For example, the foregoing embodiments of the device are merely schematic. For example, the division of the modules or units is merely a logic function division, and other division manners may be employed when it is practiced actually. For example, more units or components may be combined or may be integrated into another system. Alternatively, some features may be omitted or not be performed. Additionally, the couplings or direct couplings or communication connections between one and another as displayed or discussed may be indirect couplings or communication connections via some interfaces, devices and units, or may be in electric, mechanical or other forms.

Units described as separate parts may be or may not be separated physically. Components displayed as units may be or may not be a physical units, that is, it may be located in one place, or may be distributed onto a plurality of network units. Some or all of the units may be selected in order to achieve the objects of the solutions of the embodiments according to the actual requirements.

Additionally, various functional units in various embodiments according to the present disclosure may be integrated into one processing unit, or may be physically individual. Two or more of various function units may be integrated into one unit. The above integrated unit may be implemented in a form of hardware or in a form of functional units of software.

If the integrated unit is realized in the form of functional units of software and sold or used as an individual product, it may be stored in a computer readable storage medium. Based on such understanding, the technical scheme of the present disclosure essentially may be represented, the part of the technical scheme which contribute to the prior art may be represented, or part or all of the technical scheme may be represented, in a form of software product. The computer software product stored in a storage medium may comprise several instructions configured to allow a computer processor to perform some or all of the steps of the method described in various embodiments of the present disclosure. The foregoing storage media may comprise various media which may store program codes such as a USB flash disk, a Read-Only Memory (ROM), a Random Access Memory (RAM), magnetic disk or optical disk, etc.

The foregoing is merely embodiments of the present disclosure, and not intended to limit the scope of the present disclosure. Any equivalent structural or flow variations made on the basis of the description and the drawings of the present disclosure, and their direct or indirect applications to other relevant technical field, shall all fall into the scope of the present disclosure.

What is claimed is:

1. A bullet collecting robot, comprising:

a bullet collecting device comprising:

a collection bin including a bullet accommodating cavity and a collection opening in communication with the bullet accommodating cavity, wherein an inner wall of the collection opening includes a collection surface for bullets to roll on;

a friction roller provided at the collection opening and configured to rotate freely, wherein a rotation shaft of the friction roller is disposed opposite to and spaced from the collection surface to form a preset gap exists between a peripheral surface of the friction roller and the collection surface;

a collection driving member connected with the friction roller and configured to drive the friction roller to rotate about the rotation shaft; and a bullet classifying mechanism mounted within the collection bin and configured to separate different types of bullets, wherein when the bullets are located outside of the friction roller, the friction roller rotates such that the bullets are caught into the collection opening from the preset gap and roll into the bullet accommodating cavity along the collection surface, and wherein the friction roller comprises an inner tube, the collection driving member being a motor, a rotor of the motor being received within an opening end of the inner tube and fixedly connected with the opening end of the inner tube to cause the inner tube to rotate along with the rotor of the motor;

a travel driving mechanism configured to drive the bullet collecting device to move; and a controller connected in communication with the collection driving member and the travel driving mechanism, and configured to control the collection driving member and the travel driving mechanism.

2. The bullet collecting robot of claim 1, wherein the friction roller comprises a sponge sleeve fixedly sleeved on the inner tube.

3. The bullet collecting robot of claim 2, wherein the inner tube includes a carbon fiber tube.

4. The bullet collecting robot of claim 1, wherein the collection surface includes a rising slope surface through which the bullets roll into the bullet accommodating cavity.

5. The bullet collecting robot of claim 4, wherein the slope surface includes a flat surface or an arc-shaped surface.

6. The bullet collecting robot of claim 4, wherein the collection bin comprises:

a baseplate, a protective shield, two side plates disposed opposite to and spaced from each other and fixedly connected with the baseplate and two opposite sides of the protective shield, respectively, and an upper cover disposed opposite to the baseplate, one end of the upper cover being connected with one end of the baseplate and another end of the upper cover being connected with the protective shield, wherein the protective shield and an end of the baseplate that is distal from the upper cover together form the collection opening, and the collection surface is provided on the baseplate.

7. The bullet collecting robot of claim 6, wherein the one end of the upper cover is detachably connected with the one end of the baseplate and the other end of the upper cover is rotatably connected with the protective shield.

8. The bullet collecting robot of claim 6, wherein:

the collection driving member is a first collection driving member fixed on one of the two side plates and configured to drive one end of the friction roller, and the bullet collecting device further comprises a second collection driving member fixed on another one of the two side plates and configured to drive another end of the friction roller.

9. The bullet collecting robot of claim 1, wherein the bullet classifying mechanism comprises a partition plate mounted at an entrance of the bullet accommodating cavity and including a hollowed filter groove formed on the partition plate.

10. The bullet collecting robot of claim 9, wherein the partition plate is disposed obliquely, allowing the bullets that do not pass through the filter groove to roll along the partition plate.

11. The bullet collecting robot of claim 10, wherein one end of the partition plate close to the entrance of the bullet accommodating cavity includes a bending portion so as to form a V-shaped limiting rib.

12. The bullet collecting robot of claim 1, wherein the bullet classifying mechanism comprises:

a main pipe including a channel with a V-shaped cross section, and a plurality of branch pipes in communication with the main pipe and corresponding to different widths of the main pipe.

13. The bullet collecting robot of claim 1, wherein the travel driving mechanism comprises two differential driving wheel components disposed opposite to and spaced from each other and provided on two opposite sides of a bottom of the collection bin, respectively.

14. The bullet collecting robot of claim 13, wherein each of the differential driving wheel components comprises a traveling wheel, a wheel axle, and a chassis motor fixedly connected with the traveling wheel through the wheel axle and configured to drive the traveling wheel to rotate.

15. The bullet collecting robot of claim 14, wherein each of the differential driving wheel components further comprises a motor base having a U-shaped structure with two support arms, the wheel axle being configured to drivably pass through one of the support arms of the motor base, the chassis motor being fixedly connected with another one of the support arms of the motor base, a driving shaft of the chassis motor rotatably passing through the other one of the support arms of the motor base and being fixedly connected with the wheel axle, and a bottom of the motor base being fixedly connected with the bottom of the collection bin.

16. The bullet collecting robot of claim 13, wherein the travel driving mechanism further comprises two universal wheel disposed opposite to and spaced from each other and mounted on the bottom of the collection bin.

17. The bullet collecting robot of claim 16, wherein the two differential driving wheel components are provided at a front of the bottom of the collection bin and the two universal wheels are provided at a back of the bottom of the collection bin.

18. The bullet collecting robot of claim 1, further comprising:

a bullet supply device connected in communication with the controller and configured to output the bullets within the bullet accommodating cavity.

19. The bullet collecting robot of claim 18, wherein the bullet supply device comprises:

a rotary disk including a push plate radially extending along the rotary disk, a supply motor configured to drive the rotary disk to rotate, and an output track, one end of the output track extending out of the collection bin and another end of the output track being joined with an edge of the rotary disk, and the output track including a slide slot for rolling the bullets, wherein the push plate is configured to push, along with a rotation of the rotary disk, the bullets into the slide slot of the output track.

20. A bullet collecting robot, comprising:

a bullet collecting device comprising:

a collection bin including a bullet accommodating cavity and a collection opening in communication with the bullet accommodating cavity, wherein an inner wall of the collection opening includes a collection surface for bullets to roll on;

a friction roller provided at the collection opening and configured to rotate freely, wherein a rotation shaft of the friction roller is disposed opposite to and spaced from the collection surface to form a preset gap exists between a peripheral surface of the friction roller and the collection surface; and a collection driving member connected with the friction roller and configured to drive the friction roller to rotate about the rotation shaft, wherein when the bullets are located outside of the friction roller, the friction roller rotates such that the bullets are caught into the collection opening from the preset gap and roll into the bullet accommodating cavity along the collection surface, and wherein the friction roller comprises an inner tube, the collection driving member being a motor, a rotor of the motor being received within an opening end of the inner tube and fixedly connected with the opening end of the inner tube to cause the inner tube to rotate along with the rotor of the motor;

a travel driving mechanism configured to drive the bullet collecting device to move;

a controller connected in communication with the collection driving member and the travel driving mechanism, and configured to control the collection driving member and the travel driving mechanism; and a bullet supply device connected in communication with the controller and configured to output the bullets within the bullet accommodating cavity.

* * * * *